US008562398B2

(12) United States Patent
Tanaka et al.

(10) Patent No.: US 8,562,398 B2
(45) **Date of Patent: *Oct. 22, 2013**

(54) AIRFLOW DIFFUSER (DIFFUSER FAN) AND AIR CONDITIONER

(76) Inventors: Toshitaka Tanaka, Kanagawa (JP); Yuki Tanaka, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/064,943

(22) Filed: Apr. 27, 2011

(65) Prior Publication Data

US 2011/0206535 A1 Aug. 25, 2011

Related U.S. Application Data

(63) Continuation of application No. 11/666,686, filed on May 1, 2007.

(30) Foreign Application Priority Data

Nov. 2, 2004 (JP) ..... 2004-319707

(51) Int. Cl.
*F24F 13/065* (2006.01)

(52) U.S. Cl.
USPC ..... 454/284; 62/259.1

(58) Field of Classification Search
USPC ..... 454/284
See application file for complete search history.

(56) References Cited

U.S. PATENT DOCUMENTS 280,595 A * 7/1883 Fernie ..... 454/254
425,449 A * 4/1890 Nickum ..... 416/89
1,017,402 A * 2/1912 Gagnon ..... 454/284
3,717,509 A 2/1973 Palm et al.
3,986,794 A * 10/1976 Korn ..... 415/129
4,396,352 A * 8/1983 Pearce ..... 416/206
4,598,632 A * 7/1986 Johnson, III ..... 454/292
4,619,586 A * 10/1986 Carter ..... 416/157 R
RE33,347 E * 9/1990 Johnson, III ..... 454/292
5,029,451 A * 7/1991 Imaiida et al. ..... 62/259.1
5,097,674 A 3/1992 Imaiida et al.
5,180,284 A * 1/1993 Monrose et al. ..... 416/204 R
5,279,520 A * 1/1994 Robinson, Jr. ..... 454/328

(Continued)

FOREIGN PATENT DOCUMENTS

CN 2200789 6/1995
CN 2276129 3/1998

(Continued)

OTHER PUBLICATIONS

The Universal Diffuser Corporation, Tukahoe NY, Flexiflo MPSR-15, pp. 36, 37; Jul. 6, 1959.*

(Continued)

*Primary Examiner* — Steven B McAllister
*Assistant Examiner* — Frances H Kamps
(74) *Attorney, Agent, or Firm* — McGinn IP Law Group, PLLC

(57) ABSTRACT

An airflow diffuser including a blade wheel that includes blade members, spoke members and a hub member supporting the spoke members, and that is located so that air blown out from an air outlet of an air conditioner comes in contact over a path of rotation of the blade members, a shaft member forming an axis of rotation of the blade wheel. The blade wheel is capable of being freely rotated by at least just the air that is blown out from the air outlet.

7 Claims, 11 Drawing Sheets

(56) References Cited

U.S. PATENT DOCUMENTS

| | | | | | |
|---|---|---|---|---|---|
| 5,451,141 | A * | 9/1995 | Carvalho et al. | 416/152 |
| 5,564,980 | A | 10/1996 | Becker | |
| 5,704,832 | A * | 1/1998 | Borrell | 454/157 |
| 5,795,220 | A * | 8/1998 | Core | 454/292 |
| 5,833,530 | A * | 11/1998 | Kuo | 454/285 |
| 6,030,287 | A * | 2/2000 | Core | 454/292 |
| 6,062,820 | A * | 5/2000 | Wang | 416/210 R |
| 6,168,517 | B1 * | 1/2001 | Cook | 454/269 |
| 6,458,028 | B2 * | 10/2002 | Snyder | 454/292 |
| 6,477,321 | B2 * | 11/2002 | Reiker | 392/364 |
| 6,648,751 | B1 * | 11/2003 | Pong | 454/297 |
| 7,011,578 | B1 * | 3/2006 | Core | 454/292 |
| 7,908,879 | B1 * | 3/2011 | Chen | 62/259.1 |
| 8,016,652 | B2 * | 9/2011 | Tanaka et al. | 454/284 |
| 2001/0027086 | A1 * | 10/2001 | Snyder | 454/292 |
| 2009/0223238 | A1 * | 9/2009 | Tanaka et al. | 62/259.1 |

FOREIGN PATENT DOCUMENTS

| | | | |
|---|---|---|---|
| JP | 47-40835 | | 12/1972 |
| JP | UM-S50-131844 | A | 10/1975 |
| JP | UM-S51-137958 | A | 11/1976 |
| JP | 53-69162 | | 6/1978 |
| JP | 53-145341 | A | 12/1978 |
| JP | 61-024929 | A | 2/1986 |
| JP | 61024929 | A * | 2/1986 |
| JP | 62-151879 | | 7/1987 |
| JP | 58-102133 | | 7/1993 |
| JP | 05-223337 | | 8/1993 |
| JP | 07-041348 | | 2/1995 |
| JP | 08-280946 | A | 10/1996 |
| JP | 9-189438 | A | 7/1997 |
| JP | 2000-205617 | | 7/2000 |
| JP | 3078419 | | 4/2001 |
| JP | 2002-284265 | | 10/2002 |
| JP | 2002-284265 | A | 10/2002 |
| JP | 2003-148796 | | 5/2003 |

OTHER PUBLICATIONS

STIC NPL search.pdf.*

Demand for Trial of invalidation against corresponding granted JP Patent No. 3717509 dated Sep. 10, 2010 with English translation.

Chinese Office Action dated Jul. 4, 2008 with English translation.

Japanese Office Action dated May 12, 2005 with English translation.

International Preliminary Report.

Form PCT/IB/237.

Form PCT/IB/373.

Decision of Demand for Trial of Invalidation against original JP Patent No. 3,717,509, with partial English-language translation dated Jul. 3, 2012.

* cited by examiner

| | 1 | 2 | 3 | 4 | 5 | 6 | 7 | 8 | 9 |
|---|---|---|---|---|---|---|---|---|---|
| THO | 28 | 27.4 | 26.6 | 28.1 | 27.2 | 28.3 | 27.6 | 28 | 28.5 |
| TFO | 28 | 14.5 | 14.6 | 15.3 | 15.1 | 15.9 | 15.2 | 16.3 | 15.5 |
| TH | 28 | 25.3 | 25.4 | 25.2 | 25.1 | 25.3 | 25.8 | 25.5 | 25.6 |
| TF | 28 | 24.3 | 24.4 | 24.7 | 24.2 | 24.6 | 24.8 | 24.7 | 24.8 |

| | 1 | 2 | 3 | 4 | 5 | 6 | 7 | 8 | 9 |
|---|---|---|---|---|---|---|---|---|---|
| THO | 11 | 28.6 | 27.8 | 29.3 | 28.3 | 29.5 | 28.8 | 30.2 | 29.8 |
| TFO | 11 | 15.8 | 15.3 | 15.7 | 15.3 | 16.1 | 15.6 | 16.5 | 15.9 |
| TH | 11 | 26.1 | 26.2 | 25.9 | 26 | 26.2 | 26.4 | 26.1 | 26.4 |
| TF | 11 | 25.4 | 25.3 | 25.5 | 25.3 | 25.5 | 25.6 | 25.5 | 25.6 |

AIRFLOW DIFFUSER (DIFFUSER FAN) AND AIR CONDITIONER

RELATED APPLICATIONS

The present Application is a Continuation Application of U.S. patent application Ser. No. 11/666,686 which was filed on May 1, 2007, the disclosure of which is incorporated herein by reference.

The present disclosure relates to the subject matter contained in International Application No. PCT/JP2005/016036 filed on Sep. 1, 2005 and in Japanese Patent Application No. 2004-319707 filed on Nov. 2, 2004, which are incorporated herein by reference in their entirety.

TECHNICAL FIELD

The present invention relates to an airflow diffuser (diffuser fan) and air conditioner, which comprises that diffuser, that diffuses air blown from an air conditioner or fan duct.

When a person is in the direct path of cold air that is blown from an air conditioner, in addition to feeling cold, the cold air is said to have an effect on the body's balance. In order to protect someone that cannot avoid being in the direct path of cold air that is blown from an air conditioner, it has become common for air conditioners to be equipped with a timer function that causes the air conditioner to operate intermittently, as well as a plurality of air-direction adjustment vanes located inside the air outlet etc., and a function that makes it possible to change the direction of air blown in the up, down, left and right directions at suitable time intervals. Moreover, there are air conditioners being put into production that comprise a fluctuating function that controls the amount and direction of airflow to be as close as possible to natural airflow.

Also, there is an apparatus as disclosed in Japanese utility model application No. 3078419 that completely changes the direction of the airflow. By using this kind of apparatus, for example, cold air that is blown in the direction of a receptionist who sits at a reception desk can be turned by plate shaped members toward a specified direction (for example, toward the visitor lobby).

Patent Document 1

Japanese Utility Model Application No. 3078419

DISCLOSURE OF THE INVENTION

There is a problem with air conditioning in that each person using a space in which an air conditioner is located has his own ideal temperature, and it is difficult to adjust the temperature setting and airflow direction to where it will satisfy all people. Moreover, all kinds of air conditioners, in order to more efficiently perform heating and cooling, are designed so that they blow cold air upward and warm air downward, and when the cooling function is turned on high, they blow out cold air with a strong airflow, and when the heating function is turned on high, they blow out hot air with a strong airflow. For example, in taking a look at the cooling function, even though a switching function or fluctuating function that uses air-direction adjustment vanes is used, when the cooling function is set to high, the number of people who are in the direct path of the cold air increases, so an apparatus as disclosed in Japanese utility model application No. 3078419 becomes necessary. Furthermore, there are cases from the aspect of the installation location of the air conditioner, in which the air outlet width cannot be completely utilized and the blowing out range becomes limited, or there are cases from the aspect of aesthetics or safety, in which the range of swinging is limited.

In the airflow-direction-changing apparatus disclosed in Japanese utility model application No. 3078419 described above, direct air does not reach anywhere at all from the installation location of the apparatus, so there are some who feel comfortable and some who do not feel so comfortable in this state. For example, in the case where a ceiling mount type of air conditioner is located on the ceiling between a customer waiting room and a customer-service window, by using the air-direction-changing apparatus as disclosed in the utility model described above, it is possible to adjust the airflow so that cold air does not blow directly on a worker sitting at the customer-service window, however, cold air will not reach workers who are working behind the worker working at the customer-service window.

Moreover, in a location such as a restaurant or inside a train where there is a large incoming and outgoing of people that utilize the space, it is difficult to apply the airflow-direction-changing apparatus of the utility model described above. For example, in order to meet the demands of every time changing users, the airflow-direction-changing apparatus disclosed in the utility model described above would frequently have to be installed or removed, so a practical solution could not be obtained.

Furthermore, with the airflow-direction-changing apparatus disclosed in the utility model application described above, there is a difficulty that the convection flow of air planned for in the air conditioning design of the overall space is also prevented.

Also, similar to the airflow-direction-changing apparatus of the utility model application described above, a construction wherein an additional power source is not necessary is also desired. With such construction, there is no need to be concerned about wiring, and later installation becomes easier, as well as it becomes possible to make the overall apparatus more lightweight.

Taking the aforementioned problems into consideration, it is an object of the present invention to provide an after-installation type of airflow diffuser (diffuser fan) that operates without power, and that together with diffusing the blown airflow at a wide angle and making the room temperature uniform, becomes a countermeasure for those whose suffer from sensitivity to cold and so-called "air-conditioner sickness".

According to a first aspect of the invention, there is provided an airflow diffuser that is located near airflow outlet(s) such as from an air conditioner or air duct. This airflow diffuser comprises: a blade wheel that is formed of blade members and a hub member supporting the blade members; a shaft member that is an axis of rotation of the blade wheel; and a suspension member that suspends the shaft member below the air conditioner. The blade wheel is located so that air blown out from the air outlet(s) (i.e., at least one outlet) of the air conditioner flows over a path (orbit) of rotation of the blade members and comes in contact with the blade members so that the blade wheel is capable of being freely rotated by at least the air that is blown out from the air outlets.

Moreover, according to another aspect of the invention, there is provided an air conditioner that comprises the aforementioned air diffuser.

With this invention, it is possible to diffuse airflow that is blown out from an air conditioner or the like, so it is possible to eliminate uneven temperature in an entire room. Also, during cooling, at least while the blade members of the blade wheel are rotating, cold air that is blown out in the direction of a user is blocked and disrupted by the blade members, so the invention is effective as a measure against sensitivity to cold and so-called 'air-conditioner sickness'.

Also, the airflow diffuser (diffuser fan) of the present invention is a non-powered diffuser that does not require an additional power source, and also does not discharge extra carbon dioxide ($CO_2$) in order to diffuse airflow.

PREFERRED MODES TO CARRY OUT THE INVENTION

Figure 16:
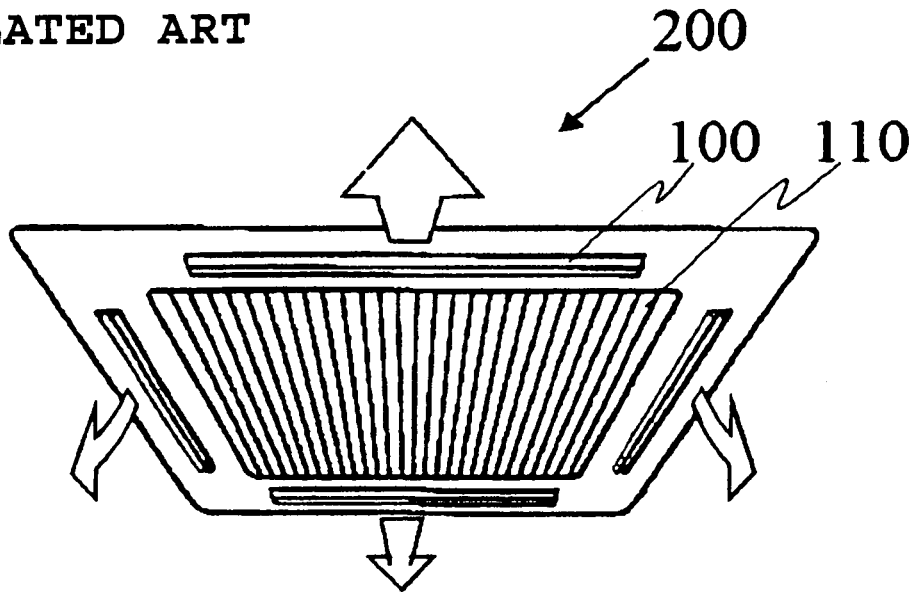
FIG. 16 RELATED ART
FIG. 16 is a drawing showing the direction of airflow from a conventional in-ceiling-mount type of air conditioner.

The preferred modes of an airflow diffuser (diffuser fan) of this invention that is post attached to an in-ceiling-mount type air conditioner installation are explained below. First, an in-ceiling type air conditioner will be explained. In-ceiling type air conditioners 200 are widely used in office buildings, stores or the like, and together with comprising an air intake 110 located in the center section of the air conditioner, comprises air outlets 100 in two to four directions, which are capable of blowing out cold air at an angle in the forward direction (see FIG. 16).

Example 1

Figure 1:
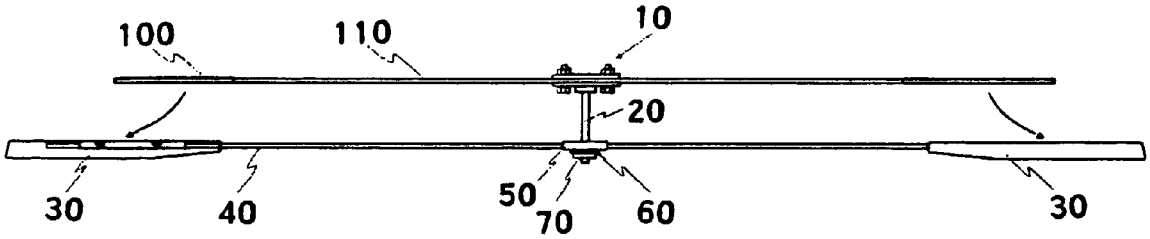
FIG. 1 is a drawing showing the general construction of an airflow diffuser (diffuser fan) of a first example of the present invention.

FIG. 1 is a drawing that shows the general construction of an airflow diffuser (diffuser fan) of a first example of the invention as seen from the side. Referring to FIG. 1, the airflow diffuser (diffuser fan) comprises a blade wheel made up of a suspension mechanism 10, a vertical shaft 20, blade members 30, spokes 40 (two of which are shown in the figure) and a hub 50, and is suspended from the grill section of the air intake 110 of the air conditioner.

The blade wheel is installed such that air blown from the air outlets 100 of the air conditioner hits the rotating path of the blade members 30. The blade members 30 of the air diffuser (diffuser fan) of the present invention are capable of sliding over the spokes 40 as will be described later, so the position of the blade members 30 can be adjusted after the airflow diffuser is installed to the air intake 110 of the air conditioner.

Figure 2:
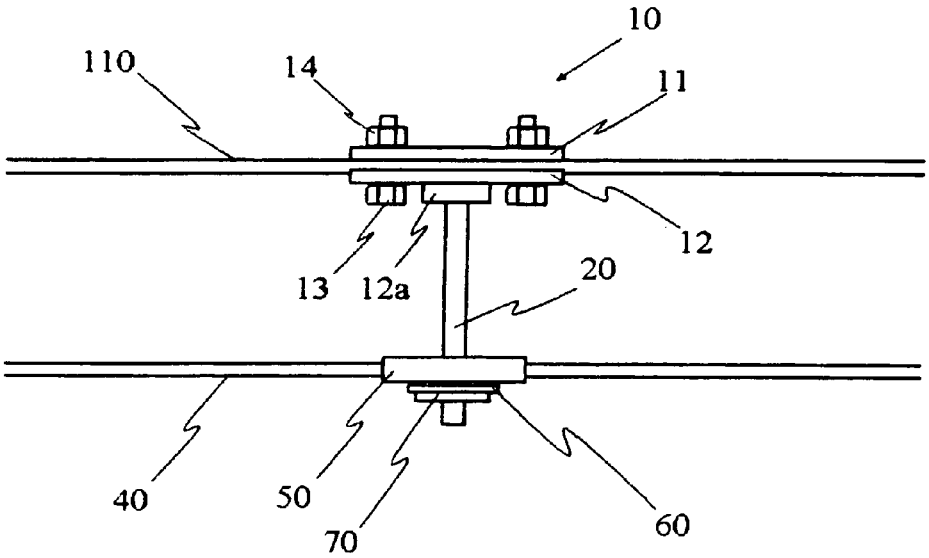
FIG. 2 is an enlarged view of FIG. 1.

FIG. 2 is an enlarged side view of the center portion of FIG. 1. As shown in FIG. 2, the suspension mechanism 10 comprises: a rear plate 11, seat (front) plate 12, and bolts 13 and nuts 14 for holding the rear plate 11 and front plate 12 on both sides of the grill portion of the air intake 110 of the air conditioner.

The rear plate 11 is located on the rear surface of the air intake of the air conditioner and is a member for fastening the entire airflow diffuser to the air intake 110 of the air conditioner. The seat (front) plate 12 has a vertical-shaft-insert section 12*a* in which screw threads are formed, and it is located on the front surface of the air intake 110 of the air conditioner and is a member that functions as a seat for installing the vertical shaft.

Also, screw threads are formed around the upper end of the vertical shaft 20 that screw into the screw threads that are formed in the vertical-shaft-insertion unit 12*a* of the seat (front) plate 12, and the lower end of the vertical shaft 20 is inserted through the hub 50 of the blade wheel described above and a bearing plate 60, and is finally fastened to an end member 70. The length of the vertical shaft 20 can be any length (for example, 60 mm) as long as the blade wheel does not interfere with the surface of the ceiling, and does not come in contact with a person's head below.

The bearing plate 60 is a ring-shaped member having a plurality of balls (steel balls, stainless steel balls, plastic balls, etc.) embedded in the top surface (upper surface), and makes it possible for the hub 50 to start rotating quickly and maintain that rotation.

Figure 3:
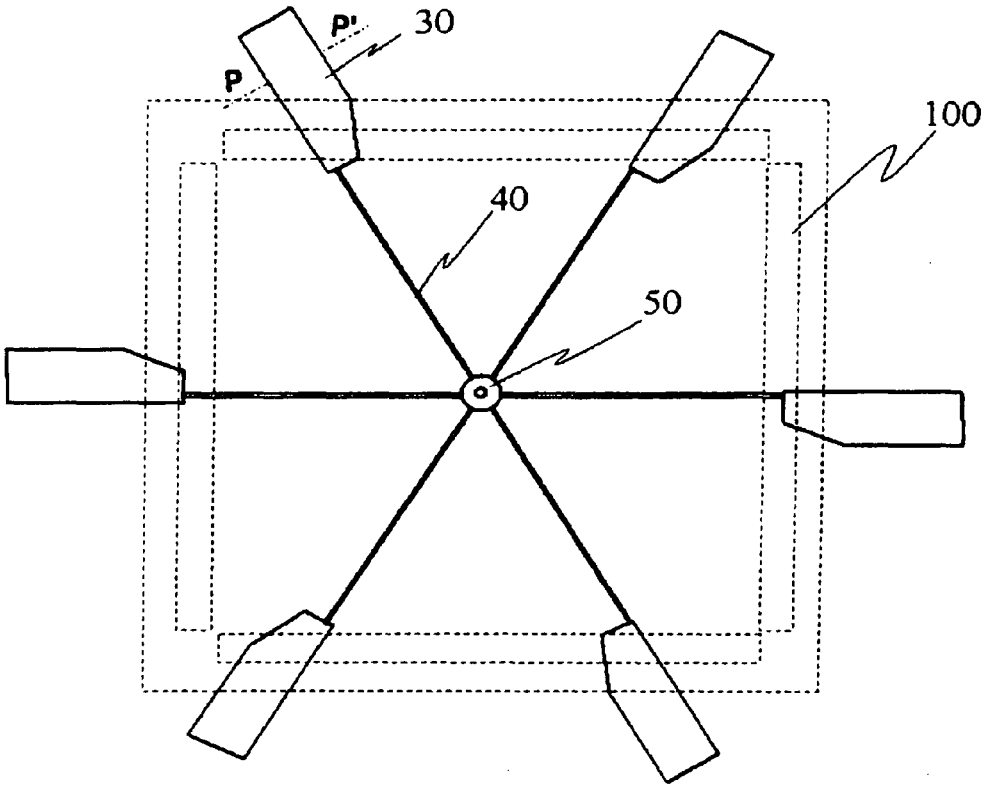
FIG. 3 is a top plan view of a blade wheel of an airflow diffuser (diffuser fan) of a first example of the present invention.

FIG. 3 is a top plan view of the blade wheel of the airflow diffuser (diffuser fan) of this first example of the invention. A six-blade blade wheel is shown in FIG. 3, where the hub 50 supports six spokes 40, and blade members 30 are mounted on the distal ends of each of the spokes 40. The blade wheel is located below the air conditioner in the center of the four air outlets 100 of the air conditioner, which forms a square shape as indicated by the dotted lines in the figure, and is such that even in the stopped position, some of the blade members 30 are located on the outer lower side of the air outlets 100, and when the blades receive blown air, the blade wheel begins to rotate.

Also, the blade wheel of this example of the invention is constructed with opposing blade members 30 on opposite sides from each other with the hub 50 in the center so that they do no obstruct the air intake 110 of the air conditioner.

Figure 4:
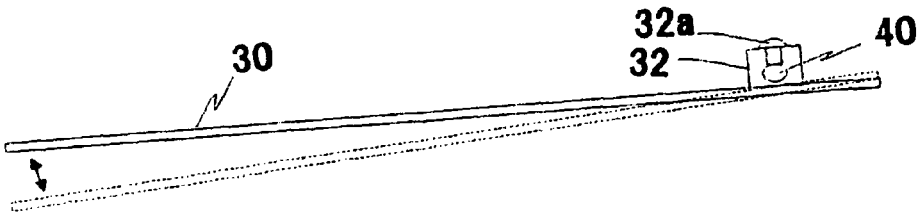
FIG. 4 is an enlarged view of cross-section P-P' of FIG. 3.
Figure 5:
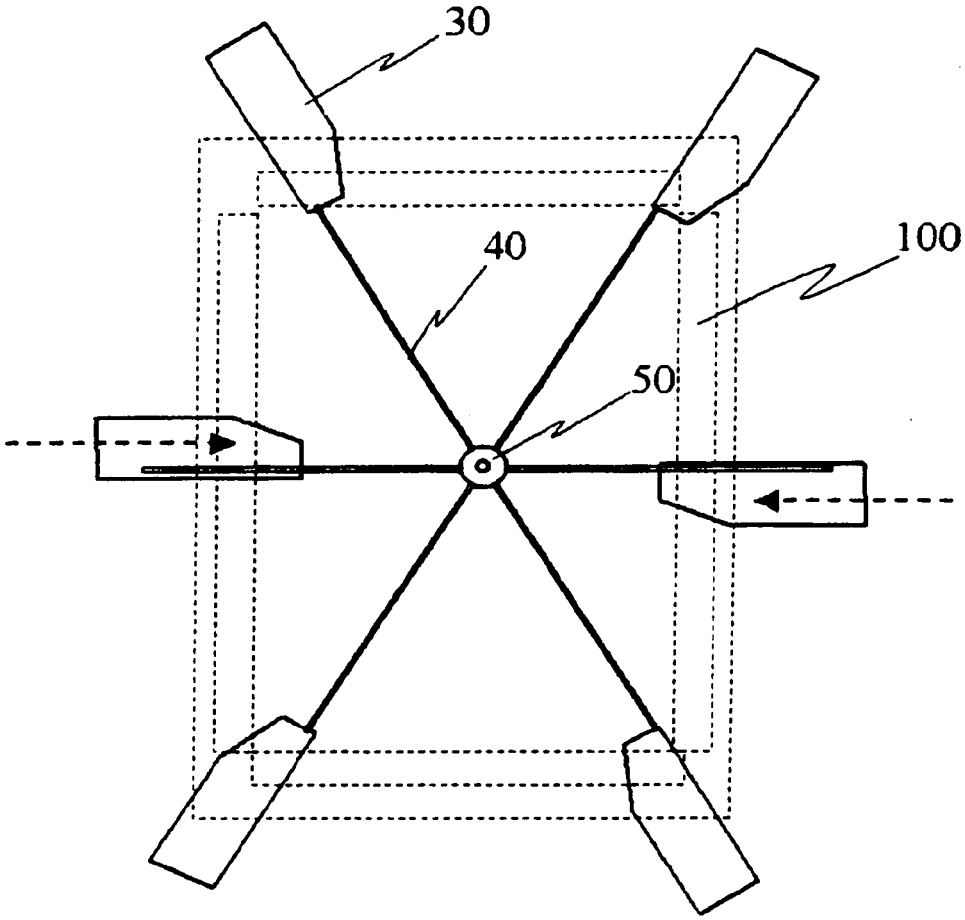
FIG. 5 is another top plan view of the blade wheel of the airflow diffuser (diffuser fan) of a first example of the present invention.

FIG. 4 is an enlarged view of the cross section P-P' of a blade member 30 in FIG. 3. Referring to FIG. 4, each of the blade members has a spoke-attachment member 32, and it is possible to insert a spoke 40 through the spoke-attachment member 32 and fasten it. Also, the cross section of the spoke 40 is circular, and by adjusting the screw 32*a* of the spoke-attachment member 32, it is possible to change the blade member 30 to a desired pitch angle and fasten the blade member to the spoke 40. Moreover, as shown in FIG. 5, by loosening the screws 32*a*, it is possible to move (displace) the blade members 30 over the spokes 40 in order to match the positions of the blade members 30 to the layout of the air outlets 100 of the air conditioner, or to increase or decrease the diameter of the blade wheel within a range (for example, 2000 m) that is regulated by the relationship between the spokes 40 and the spoke-attachment members 32.

Aluminum plate, acrylic plate or the like can suitably be used for the blade members 30. Also, since the blade wheel does not actively operate to create airflow, so it is not necessary to use special highly rigid material or construction for the blade members 30.

As shown in FIG. 1, depending on the number, shape, surface area, pitch and the like of the blade members 30 of the blade wheel, the airflow diffuser (diffuser fan) that is constructed as described above receives air that is blown out from the air outlets 100 of the air conditioner and rotates due to the force of that blown air, and the rotating blade members 30 successively receive and deflect the blown air, whereby the blown air is diffused throughout the entire air-conditioned space.

Also, it is possible to create a state or interval where a blade member 30 is at least located between an air outlet 100 and a user at any specified time interval, which makes it possible to shorten the amount (period) of time that cold air is blown directly on the user.

Figure 6:
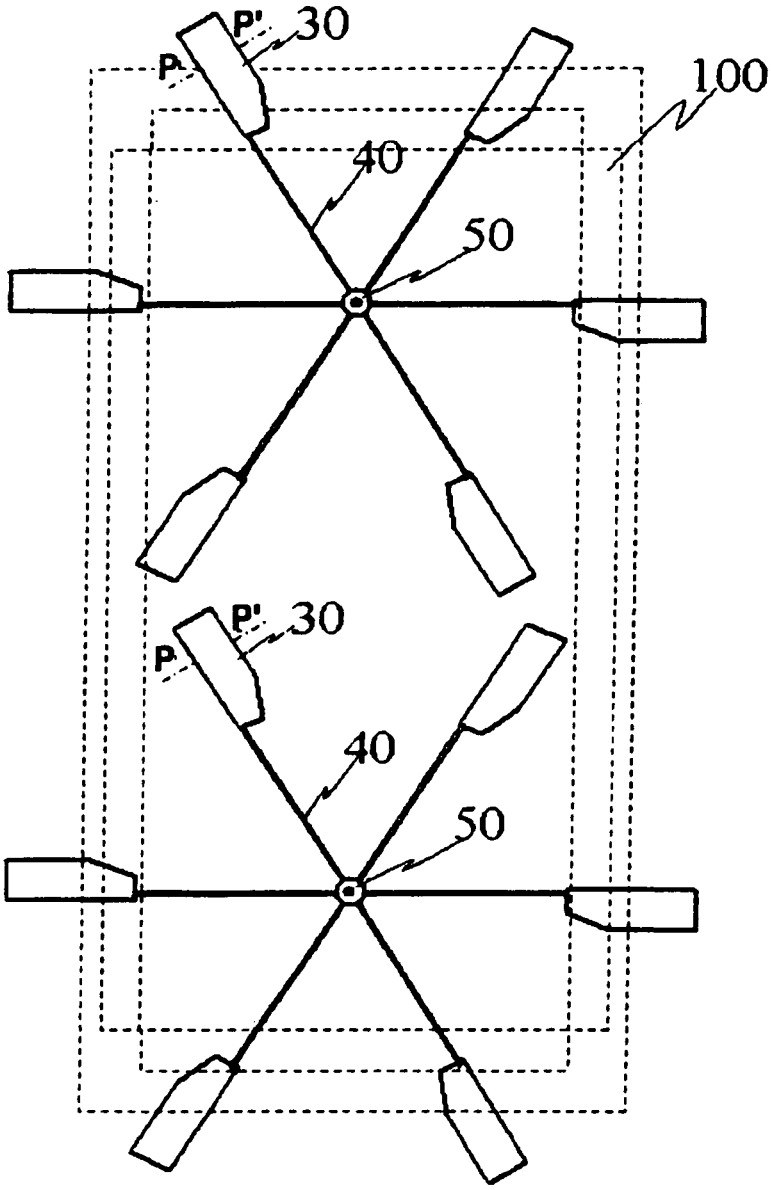
FIG. 6 is another top plan view of the blade wheel of the airflow diffuser (diffuser fan) of a first example of the present invention.

As shown in FIG. 6, it is also possible to install two or more airflow diffusers (fan diffusers) as described above to the air outlets 100 of the air conditioner.

Figure 7:
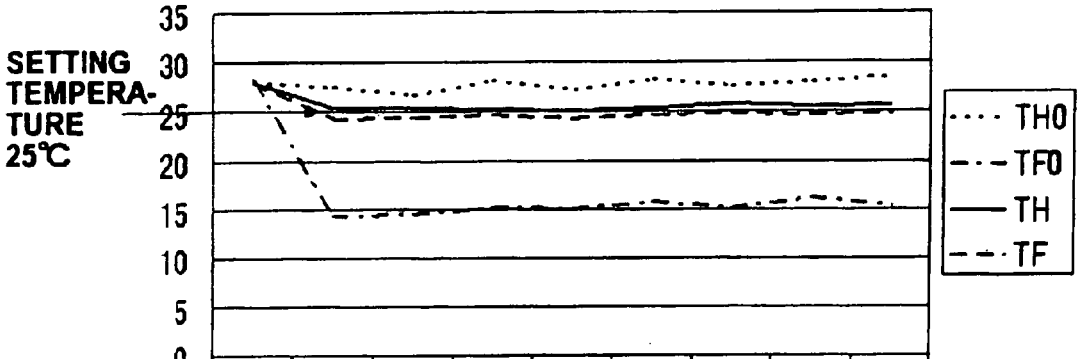
FIG. 7 is a drawing for explaining the temperature change (during cooling) of an air-conditioned space that is conditioned by the airflow diffuser (diffuser fan) of a first example of the present invention.

FIG. 7 is a drawing for explaining the temperature change (during cooling) by the airflow diffuser (diffuser fan) of this first example of the invention. FIG. 7 shows the temperature change at each hour during the cooling operation of an in-ceiling type air conditioner having an output of 3.75 kW. Measurement is performed for a room having a width of approximately 8 m×a depth (length) of approximately 8 m×a ceiling height of 2.6 m, in which an air conditioner is set in the center of the ceiling. Also, the outside temperature during measurement was 30° C., the initial room temperature was 28° C., and measurement was performed with the air conditioner set to a temperature of 25° C. and the auto operation mode. A radiation type thermometer and an air temperature measurement device were used for temperature measurement.

TH0 and TH in FIG. 7 show the change in temperature in the room at a height of 1.1 m above the floor, which is the estimated height of a seated person's head, where TH0 (dotted line) shows the measurement results when the airflow diffuser (diffuser fan) of this example is not used, and TH (solid line) shows the measurement results when the airflow diffuser (diffuser fan) of this example is used.

TF0 and TF in FIG. 7 show the change in temperature in the room at a height of 0.5 m above the floor, which is the estimated height of a person's feet, where TF0 (dashed-dotted line) shows the measurement results when the airflow diffuser (diffuser fan) of this example is not used, and TF (dashed line) shows the measurement results when the airflow diffuser (diffuser fan) of this example is used.

As can clearly be seen from TH0 and TF0 in FIG. 7, when the airflow diffuser (diffuser fan) of this example is not used, a difference between the temperature at a height of 1.1 m and height of 0.5 m of about 13° C. occurs, and the temperature is particularly low near the feet. On the other hand, when the airflow diffuser (diffuser fan) of this example is used, both TH and TF approach a temperature near the set temperature of 25° C., and the temperature difference between them is kept within 1° C., so it can be seen that the entire air-conditioned space is mixed well.

Figure 8:
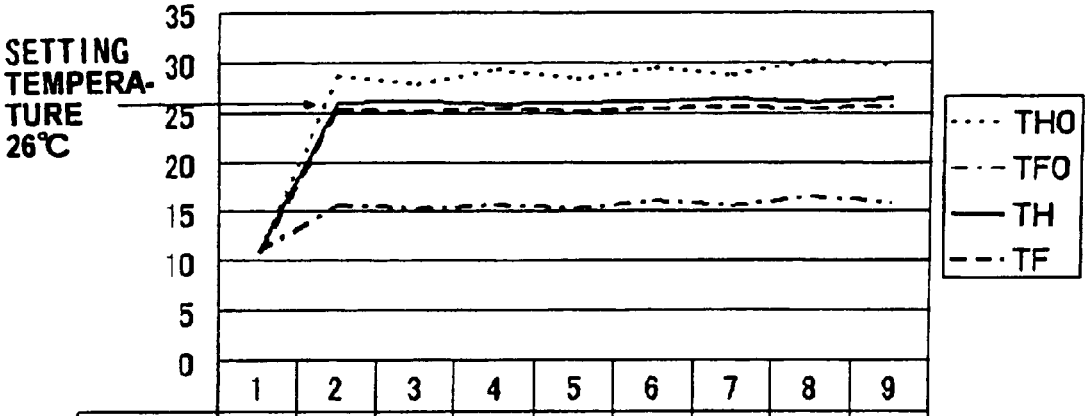
FIG. 8 is a drawing for explaining the temperature change (during heating) of an air-conditioned space that is conditioned by the airflow diffuser (diffuser fan) of a first example of the present invention.

FIG. 8 is a drawing for explaining the temperature change (during heating) of space that has been air conditioned by the airflow diffuser (diffuser fan) of this first example of the invention. FIG. 8 shows the temperature change at each hour during the heating operation of an in-ceiling type air conditioner having an output of 3.75 kW. Measurement is performed for a room having a width of approximately 8 m×a depth (length) of approximately 8 m×a ceiling height of 2.6 m, in which an air conditioner is set in the center of the ceiling. Also, the outside temperature during measurement was 7° C. the initial room temperature was 11° C. and measurement was performed with the air conditioner set to a temperature of 26° C. and the auto operation mode. A radiation type thermometer and an air temperature measurement device were used for temperature measurement.

TH0 and TH in FIG. 8 show the change in temperature in the room at a height of 1.1 m above the floor, which is the estimated height of a seated person's head, where TH0 (dotted line) shows the measurement results when the airflow diffuser (diffuser fan) of this example is not used, and TH (solid line) shows the measurement results when the airflow diffuser (diffuser fan) of this example is used.

TF0 and TF in FIG. 8 show the change in temperature in the room at a height of 0.5 m above the floor, which is the estimated height of a person's feet, where TF0 (dashed-dotted line) shows the measurement results when the airflow diffuser (diffuser fan) of this example is not used, and TF (dashed line) shows the measurement results when the airflow diffuser (diffuser fan) of this example is used.

As can be clearly seen from TH0 and TF0 in FIG. 8, when the airflow diffuser (diffuser fan) of this example is not used, a difference between the temperature at a height of 1.1 m and height of 0.5 m of about 13° C. occurs, and the temperature is particularly low near the feet and the temperature near the head is too high. On the other hand, when the airflow diffuser (diffuser fan) of this example is used, both TH and TF approach a temperature near the set temperature of 26° C. and the temperature difference between them is kept within 1° C., so it can be seen that the entire air-conditioned space is mixed well.

Example 2

Figure 9:
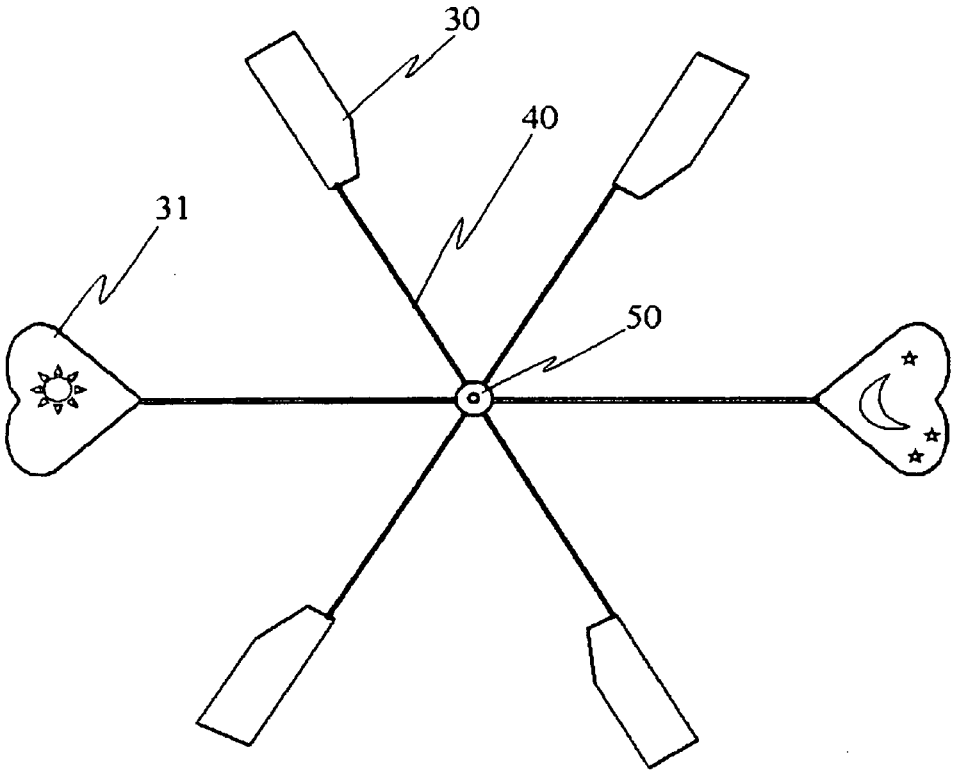
FIG. 9 is a top plan view of a blade wheel of an airflow diffuser (diffuser fan) of a second example of the present invention.

Next, a second example of the invention will be explained. In this example, some of the blade members 30 of the blade wheel of the first example described above have been changed to be decorative blades having decorative shapes and/or pictures. FIG. 9 is a top plan view of the blade wheel of the airflow diffuser (diffuser fan) of this example. FIG. 9 shows a six-bladed blade wheel of which two of the six spokes 40 have decorative blades 51 (sic 31) having decorative shapes and pictures. As described above, in this invention, it is possible to decrease the rotation speed of the blade wheel by adjusting the pitch angle of the blades, so by adjusting the pitch angle of the blade members 30, it is possible to enjoy the movement of the decorative blades 51 (sic 31).

Example 3

Figure 10:
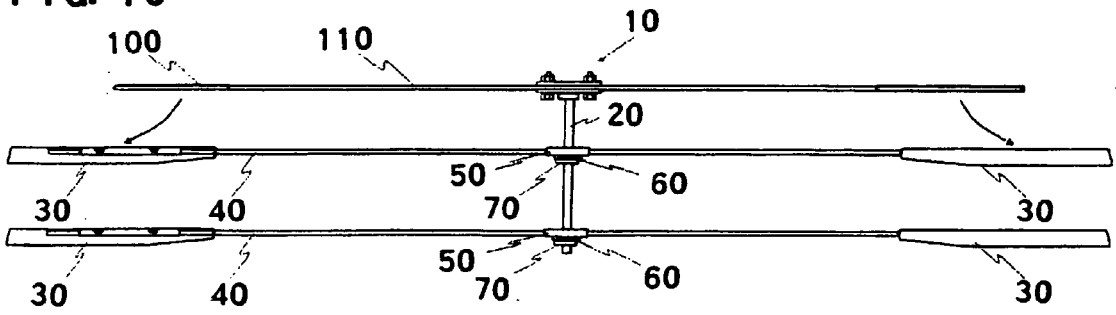
FIG. 10 is a drawing showing the general construction of the airflow diffuser (diffuser fan) of a third example of the present invention.

Next, a third example of the invention is explained. In this example, a plurality of the blade wheels of the first and second example is arranged in the vertical direction. FIG. 10 is a side view of the airflow diffuser (diffuser fan) of this example. FIG. 10 shows construction in which two blade wheels are arranged on one vertical shaft 20. With this construction, depending on the number of blade wheels, it is possible to increase the timing at which a blade member 30 is located between an air outlet 100 and a user. Also, by changing the size of the diameters of the blade wheels, or changing the number, shape, surface area or pitch angle of the blade members 30, it is possible to enjoy the difference in the relative rotational movement of the blade wheels.

Example 4

Figure 11:
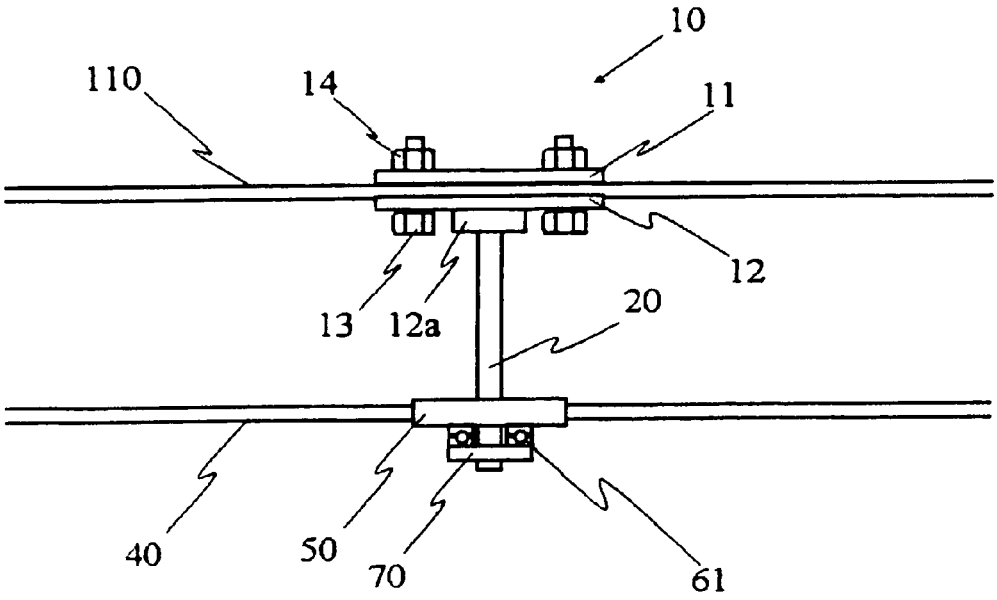
FIG. 11 is a drawing showing the construction of the airflow diffuser (diffuser fan) of a fourth example of the present invention.

Next, a fourth example of the invention will be explained. In this example, a thrust bearing 61 is used instead of the bearing plate 60 used in the examples described above. FIG. 11 shows the construction as seen from the side of the airflow diffuser (diffuser fan) of this example. In addition to the ball bearing shown in FIG. 11, it is also possible to add various kinds of thrust bearings, such as an electromagnetic bearing.

Example 5

Figure 12:
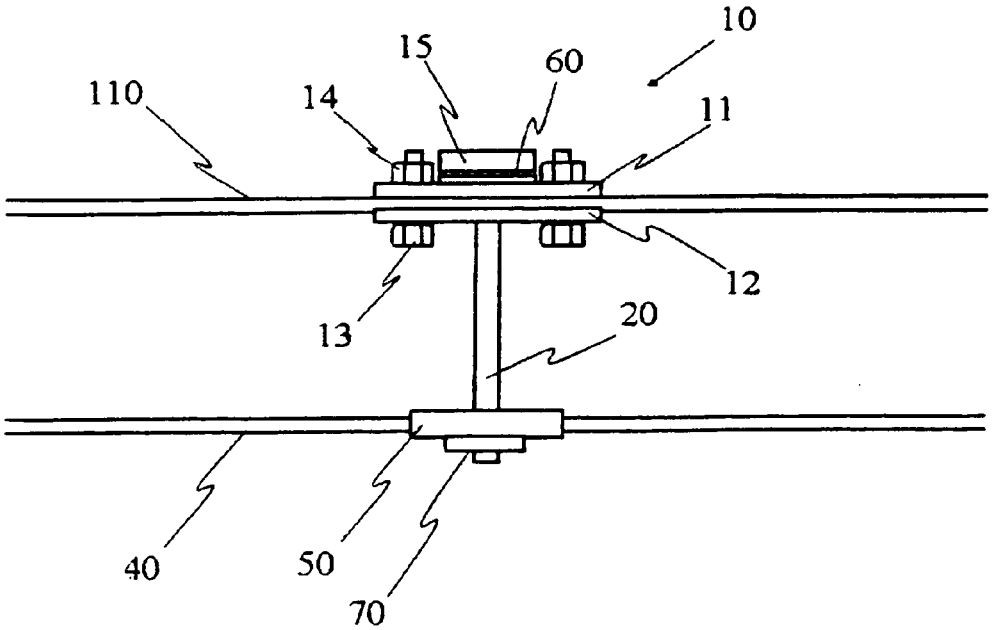
FIG. 12 is a drawing showing the construction of an airflow diffuser (diffuser fan) of a fifth example of the present invention.

Next, a fifth example of the invention will be explained. In this example, the bearing plate 60 and thrust bearing 61 used in the examples described above are located on the side of the suspension member 10, and a hub 50 is fastened (fixed) to the vertical shaft 20. FIG. 12 shows the construction as seen from the side of the airflow diffuser (diffuser fan) of this example. As shown in FIG. 12, a suspension end 15 is fastened to the upper end of the vertical shaft 20, and the bearing plate 60 is located on the underneath surface of that suspension end 15.

Example 6

Figure 13:
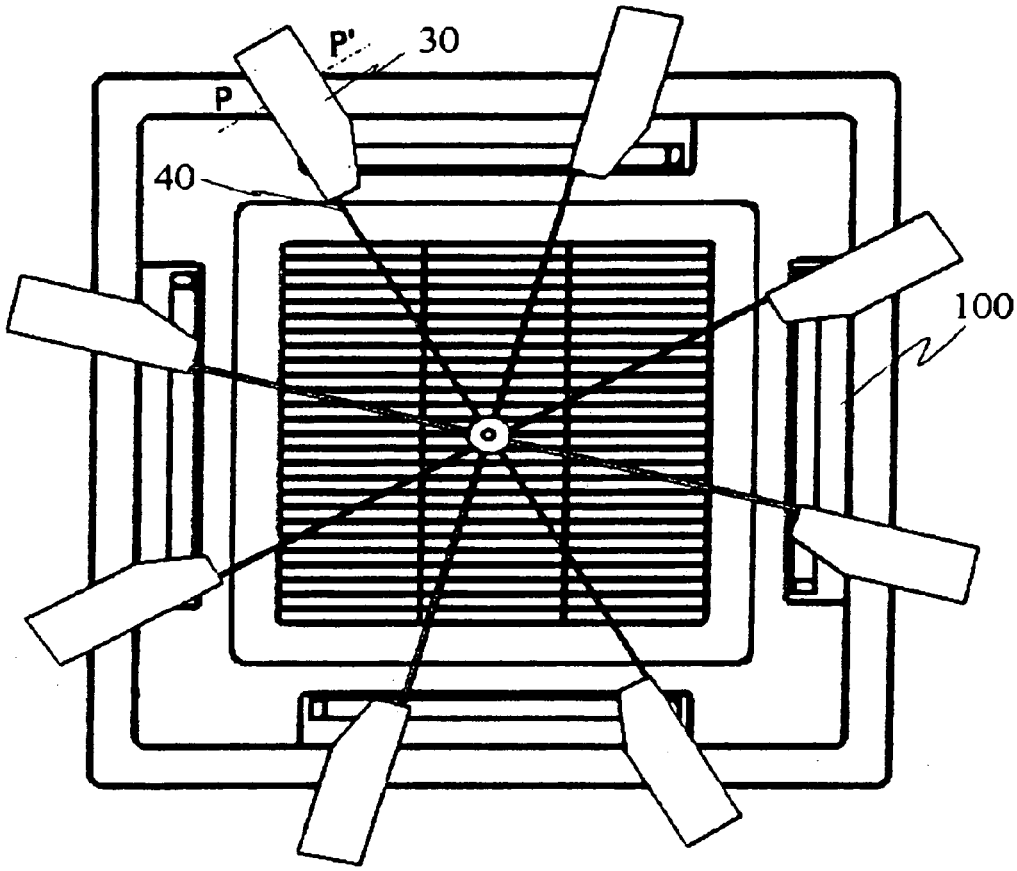
FIG. 13 is a top plan view of a blade wheel of an airflow diffuser (diffuser fan) of a sixth example of the present invention.
Figure 14:
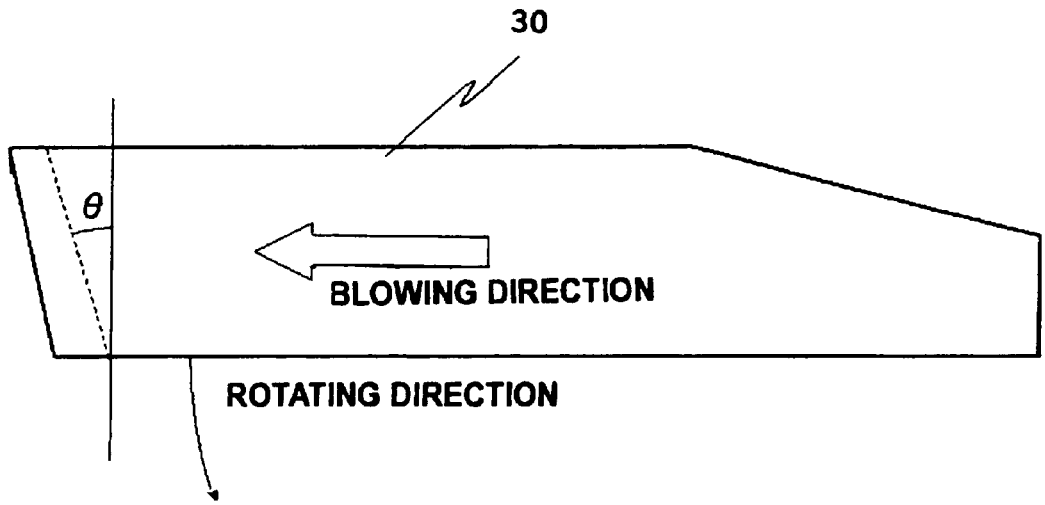
FIG. 14 is a top plan view of a blade member of a seventh example of the invention.
Figure 15:
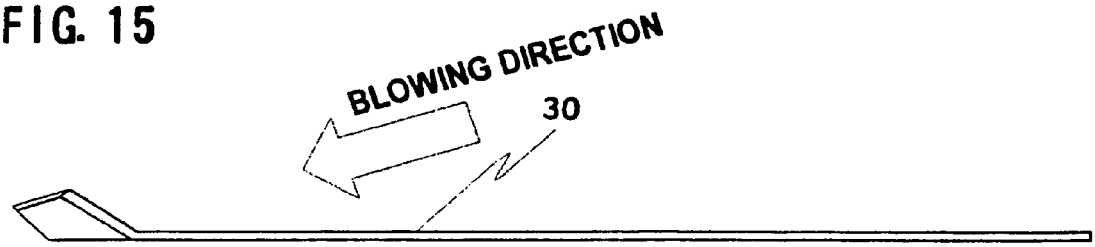
FIG. 15 is a side view of the blade member of the seventh example of the invention.

Next, a sixth example of the invention will be explained. As shown in FIG. 13, in this example, a blade wheel having eight spokes is used. The remaining part of this example is the same as the airflow diffuser (diffuser fan) of the examples described above.

Several preferred examples of attaching the present invention to an installed in-ceiling type air conditioner after installation were explained, however, the invention is not limited to these examples, and needless to say other variations are possible.

For example, in the examples described above, an airflow diffuser (diffuser fan) that can be attached to an installed in-ceiling type air conditioner after installation was explained, however, the invention can also be applied to air conditioners other than an in-ceiling type air conditioner. There are other kinds of air conditioners such as wall-mounted exposed type air conditioners, or ceiling-suspended type (exposed type) air conditioners, and by placing one or a plurality of blade wheels as described above near the air outlets, the blade wheel will rotate due to the blown air and will diffuse the airflow of that blown air, and thus the blade wheel can disrupt the direct flow of air at least when a blade member passes by.

Furthermore, in order to function as a ceiling fan, it is possible to connect an electric motor to the upper end of the vertical shaft 20 (side of the air conditioner) that is capable of driving the blade wheel when the air conditioner is not in operation, and to install a switching mechanism that can switch the operating mode of the fan (diffuser fan mode/ceiling fan mode).

Also, in the examples described above a suspension member was explained that comprises of a rear plate 11, front plate 12, and bolts 13 and nuts 14 that hold the plates together, and that suspends a vertical shaft 20 from the surface of the ceiling, however, as long as it is capable of supporting the weight of the blade wheel and shaft, the front plate 12 could be constructed so that it is directly attached to the ceiling. Also, as appropriate, it is possible to disperse the load by using a chain, cord, wire or the like to connect the middle section of the vertical shaft 20 to a hook that is separately embedded in the ceiling.

Moreover, by constructing the grill portion of the air intake of the air conditioner so that it is capable of supporting the vertical shaft 20, or by constructing the grill portion of the air intake of the air conditioner so that the front plate 12 can be attached, an air conditioner comprising the function of the airflow diffuser (diffuser fan) described above can be obtained.

Furthermore, in the examples described above, construction of blade members 30 having spoke-attachment units 32 of which the pitch angle can be changed and that can be moved over the spoke 40 was explained, however, it is also possible to use a blade wheel having a fixed pitch or fixed layout.

Similarly, in the examples described above, an airflow diffuser (diffuser fan) that uses a blade wheel having six to eight trapezoidal blades members 30 was explained, however, by changing the hub 50, it is possible to employ construction that uses other pluralities of blade members. Also, the shape of the blade members 30 can of course be a geometrical shape, however, various shapes, such as an oar shape or rugby ball shape, can be also used as long as the blade wheel can rotate.

Moreover, in the examples described above, construction in which blade members 30 are attached to spoke members 40 was explained, however, it is also possible to employ construction of a blade wheel in which there are connection units on the blade members 30 that connect to the hub member 50, making it possible to eliminate the spoke members 40. In this case, the blade wheel used would generally have a fixed diameter and fixed blade layout. Of course, by preparing blade wheels having different diameters or blade layouts beforehand, the entire blade wheel could be replaced.

Also, it is possible to connect a motor to the vertical shaft 20 that is capable of rotating the blade wheel, for example, to the upper end of the vertical shaft, and to circulate air by diffusing the airflow according to the theory described above when the air conditioner is in operation, and rotating the blade wheel by the motor when the air conditioner is not in operation.

The invention claimed is:

1. An airflow diffusing apparatus comprising:

a blade wheel that includes blade members, spoke members and a hub member supporting said spoke members, and that is located so that air blown out from an air outlet of an air conditioner comes in contact over a path of rotation of said blade members;

a shaft member forming an axis of rotation of said blade wheel; and a suspension member that suspends said shaft member from a front surface of an air intake of said air conditioner below said air conditioner such that the shaft member is secured by the suspension member in a direction away from said front surface toward the blade wheel, wherein said blade wheel is capable of being freely rotated by at least just the air that is blown out from said air outlet, and wherein the airflow blown out from said air outlet is intermittently deflected outwardly by said blade members.

2. The air diffusing apparatus according to claim 1, wherein a pitch angle of said blade members can be changed.

3. The air diffusing apparatus according claim 1, wherein said blade members are capable of being moved over said spoke members.

4. The air diffusing apparatus according to claim 1, wherein a bearing member is disposed on said shaft member to support a load of said blade wheel.

5. The air diffusing apparatus according to claim 1, wherein the air outlet comprises a pair of air outlets and said suspension member suspends said shaft member between the pair of air outlets.

6. An air conditioner comprising the air diffusing apparatus according to claim 1.

7. The air diffusing apparatus according to claim 1, wherein said shaft member is disposed at a position not in registration with the air outlet.

* * * * *